US008083107B2

(12) United States Patent
Laible

(10) Patent No.: US 8,083,107 B2
(45) Date of Patent: Dec. 27, 2011

(54) CLOSED LOOP DISPENSING SYSTEM WITH MECHANICAL VENTING MEANS

(76) Inventor: Rodney Laible, Omaha, NE (US)

( * ) Notice: Subject to any disclaimer, the term of this patent is extended or adjusted under 35 U.S.C. 154(b) by 443 days.

(21) Appl. No.: 12/384,857

(22) Filed: Apr. 9, 2009

(65) Prior Publication Data

US 2010/0258593 A1 Oct. 14, 2010

(51) Int. Cl.
*B67D 3/00* (2006.01)

(52) U.S. Cl. ..... 222/478; 222/189.09

(58) Field of Classification Search ..... 222/478, 222/189.1, 189.09, 189.06, 189.11, 464.1, 222/464.2, 572, 546, 547; 251/149, 149.4, 251/149.6, 149.8; 137/590, 614.2
See application file for complete search history.

(56) References Cited

U.S. PATENT DOCUMENTS

| | | | | |
|---|---|---|---|---|
| 2,913,749 | A | 3/1958 | Ayres | |
| 2,849,163 | A | 8/1958 | Soffer et at | |
| 3,556,353 | A | 1/1971 | Echols | |
| 3,951,293 | A | 4/1976 | Schulz | |
| 4,159,790 | A | 7/1979 | Bailey | |
| 4,401,272 | A | 8/1983 | Merton et al. | |
| 4,445,539 | A | 5/1984 | Credle | |
| 4,564,117 | A | 1/1986 | Herbert | |
| 4,646,945 | A | 3/1987 | Steiner et al. | |
| 4,673,404 | A | 6/1987 | Gustavsson | |
| 4,722,450 | A | 2/1988 | Mario | |
| 4,862,918 | A | 9/1989 | Schroeder | |
| 4,863,051 | A | 9/1989 | Eibner et al. | |
| 4,875,603 | A | 10/1989 | Weinstein | |
| 4,886,193 | A | 12/1989 | Wassilieff | |
| 4,967,922 | A | 11/1990 | Alder | |
| 5,048,705 | A | 9/1991 | Lynd et al. | |
| 5,048,723 | A | 9/1991 | Seymour | |
| 5,082,150 | A | 1/1992 | Steiner et al. | |
| 5,107,909 | A | 4/1992 | Donovan | |
| 5,165,578 | A | 11/1992 | Laible | |
| 5,232,110 | A | 8/1993 | Purnell | |
| 5,275,310 | A | 1/1994 | Mielnik et al. | |
| 5,350,091 | A | 9/1994 | Leete et al. | |
| 5,368,205 | A | 11/1994 | Groh | |
| 5,413,152 | A | 5/1995 | Burrows | |
| 5,445,186 | A * | 8/1995 | Richter et al. | 137/614.2 |
| 5,472,124 | A | 12/1995 | Martushev | |
| 5,529,223 | A | 6/1996 | Fisher | |
| 5,588,565 | A | 12/1996 | Miller | |
| 5,645,192 | A | 7/1997 | Amidzich | |
| 5,803,311 | A | 9/1998 | Fuchs | |
| 5,988,456 | A | 11/1999 | Laible | |
| 6,062,435 | A | 5/2000 | Hess, III | |
| 6,142,345 | A | 11/2000 | Laible | |
| 6,299,037 | B1 | 10/2001 | Lee | |
| 6,364,163 | B1 | 4/2002 | Mueller | |
| 6,968,983 | B2 | 11/2005 | Laible | |
| 7,686,194 | B2 * | 3/2010 | Kasting | 222/549 |

* cited by examiner

*Primary Examiner* — Lien Ngo
(74) *Attorney, Agent, or Firm* — Dennis L. Thomte; Thomte Patent Law Office LLC

(57) ABSTRACT

A closed loop dispensing system including a mechanical venting assembly which ensures that sufficient air may enter the interior of the container as liquid is being drawn from the container. The mechanical venting assembly of this invention ensures that the vent openings associated therewith will not become plugged with debris.

3 Claims, 5 Drawing Sheets

CLOSED LOOP DISPENSING SYSTEM WITH MECHANICAL VENTING MEANS

BACKGROUND OF THE INVENTION

1. Field of the Invention

This invention relates to a closed loop dispensing system and more particularly to a dispensing system for dispensing corrosive liquid chemicals or dangerous medical liquid products which are typically drawn from a container such as a bottle or the like to a mixing machine or the like. Even more particularly, this invention relates to a closed loop dispensing system including a mechanical venting means for a throat plug assembly which is mounted in the throat of a liquid container.

2. Description of the Related Art

Corrosive liquid chemicals and dangerous medical liquid products are typically contained in a container such as a bottle or the like and are frequently dispensed therefrom to a mixing machine. Normally, a cap is place on the bottle with a dip tube extending therefrom downwardly into the interior of the bottle for drawing the liquid upwardly thereinto. Normally, a dispensing tube extends from the cap from a mixing machine or to some other piece of equipment which creates suction in the dispensing tube to draw the liquid from the interior of the bottle.

Applicant has previously many patented closed loop dispensing systems with improved safety means and with improved venting. For example, see U.S. Pat. No. 5,988,456.

In the prior art dispensing systems, Gortex® membranes are extended over vent openings so that air may be drawn into the interior of the bottle as liquid is being dispensed therefrom to prevent collapsing of the bottle. Although Applicant's previous inventions work extremely well, it has been found that when the liquid of the container splashes onto or comes into the Gortex® membrane the liquid may calcify on the membrane and may retard the venting of the vent opening.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

This invention relates to a dispensing system for use with a container, such as a bottle or the like, having a hollow throat extending upwardly therefrom which has interior and exterior surfaces. A throat plug assembly, having upper and lower ends, is positioned in the throat of the container with the throat plug assembly remaining in the container during shipment and during the actual use thereof. The throat plug assembly includes an upstanding, ring-shaped wall means at its upper end which engages the interior surface of the hollow throat of the container. The throat plug assembly has a horizontally disposed upper wall which extends between the wall means. The upper wall of the throat plug assembly has a central opening formed therein. The throat plug assembly includes a valve and vent assembly. The valve and vent assembly includes a fixed lower end having a central opening formed therein with the lower end having a plurality of vent openings formed therein. An upstanding hollow valve body extends upwardly from the fixed lower end and has a closed upper end and an open lower end. The open lower end of the valve body is in fluid communication with the central opening in the lower wall. A dip tube is in communication with the open lower end of the valve body and is in communication with the liquid in the liquid container. The valve and vent assembly includes a portion thereof which is vertically movably mounted on the valve body.

The portion of the valve and vent assembly, which is vertically movable on the valve body, includes a vertically disposed, hollow tubular valve means having upper and lower ends, and a horizontally disposed disc extending from the tubular valve means adjacent the lower end thereof. The tubular valve means is vertically movably mounted on the upper end of the valve body and embraces the same. The valve and vent assembly is movable between upper and lower positions with respect to the valve body. The valve and vent assembly, when in its upper position, closes the opening formed in the valve body below the upper end thereof. The disc of the valve and vent assembly has a plurality of vent pins extending downwardly therefrom which are received in the vent openings. The vent pins close the associated vent openings when the valve and vent assembly is in its upper position.

The vent pins permit air to pass through the associated vent openings when the valve and vent assembly is in its lower position. A spring is positioned between the lower wall and the disc of the valve and vent assembly which normally urges the valve and vent assembly to its upper position. The movement of the vent pin between its upper and lower positions prevents the accumulation of debris in the associated vent opening. The valve body and the tubular valve means extend upwardly through the central opening in the upper wall of the throat plug assembly.

A cap is removably mounted on the throat of the container for selectively closing the throat. A dispensing tube extends from the cap for dispensing liquid from the container. The cap includes means for engagement with the valve to move the valve downwardly to its lower position when the cap is mounted on the container to close the throat. The downward movement of the valve by the cap also causes the vent pins to open the vent openings.

It is therefore a principal object of the invention to provide an improved closed loop dispensing system including mechanical venting means.

A further object of the invention is to provide a closed loop dispensing system including a mechanical venting means which prevents the vent openings thereof from becoming plugged with debris.

Still another object of the invention is to provide a closed loop dispensing system with mechanical venting means which ensures that sufficient air will be vented into the interior of the liquid container as liquid is being drawn therefrom.

Still another object of the invention is to provide a closed loop dispensing system including a vent means which may function to relieve pressure within the liquid container during the shipment thereof.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
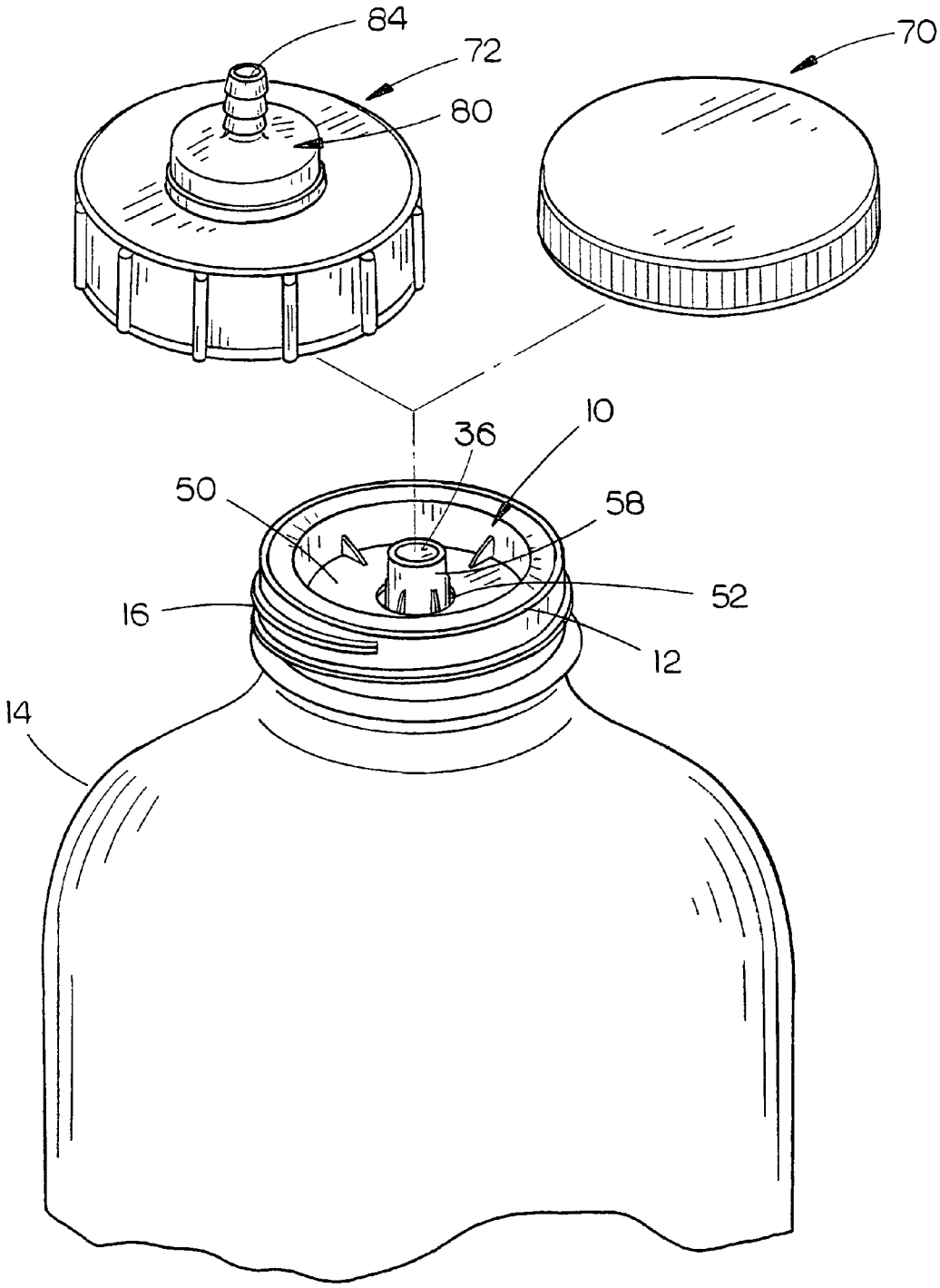
FIG. 1 is a perspective view illustrating the invention together with a shipment cap and an operational cap.
Figure 3:
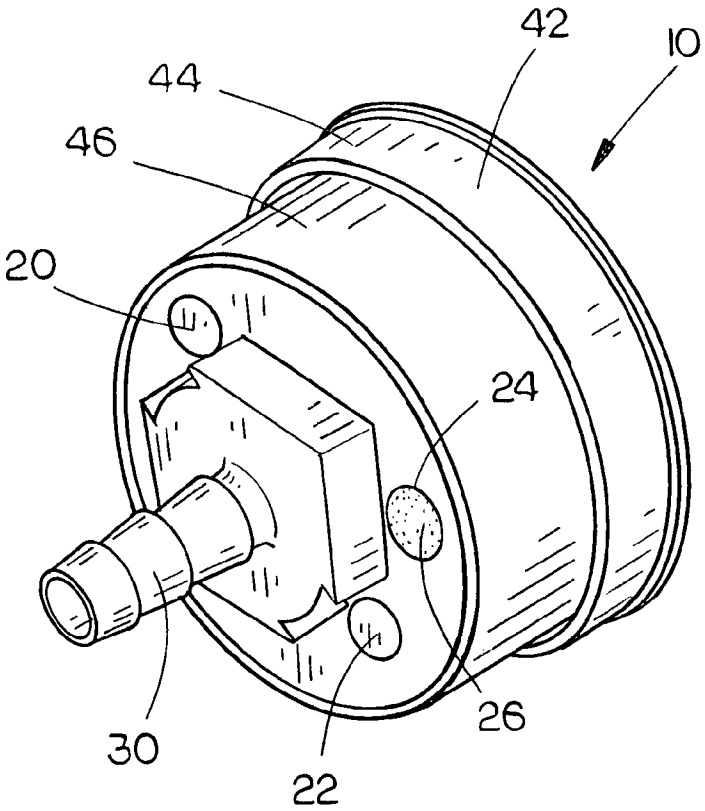
FIG. 3 is a bottom perspective view of the throat plug assembly of this invention.
Figure 2:
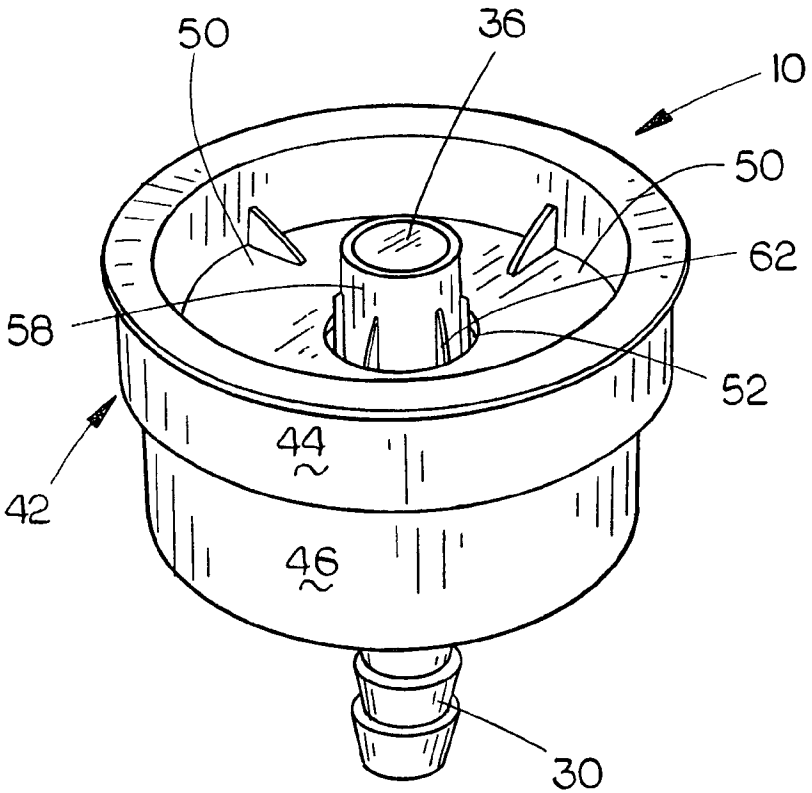
FIG. 2 is a perspective view of the throat plug assembly of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to a throat plug assembly which is press-fitted into the throat or outlet opening 12 of a container 14 such as a bottle or the like. Preferably, throat 12 includes external threads 16. Assembly 10 includes an externally threaded disc member 18 having a pair of vent openings 20 and 22 formed therein as well as a vent opening 24 formed therein with the vent opening having a Gortex® material 26 therein which permits air to flow through while preventing the flow of liquid therethrough. Disc member 18 includes external threads 28 for a purpose to be explained hereinafter. Hollow dip tube support 30 extends downwardly from disc member 18 and has the upper end of a dip tube 32 mounted thereon which extends downwardly into the bottle 14 and which has a length sufficient so that it may extend into a bottom corner of the bottle 14. Normally, a conventional metering insert will be provided in dip tube 32.

Figure 6:
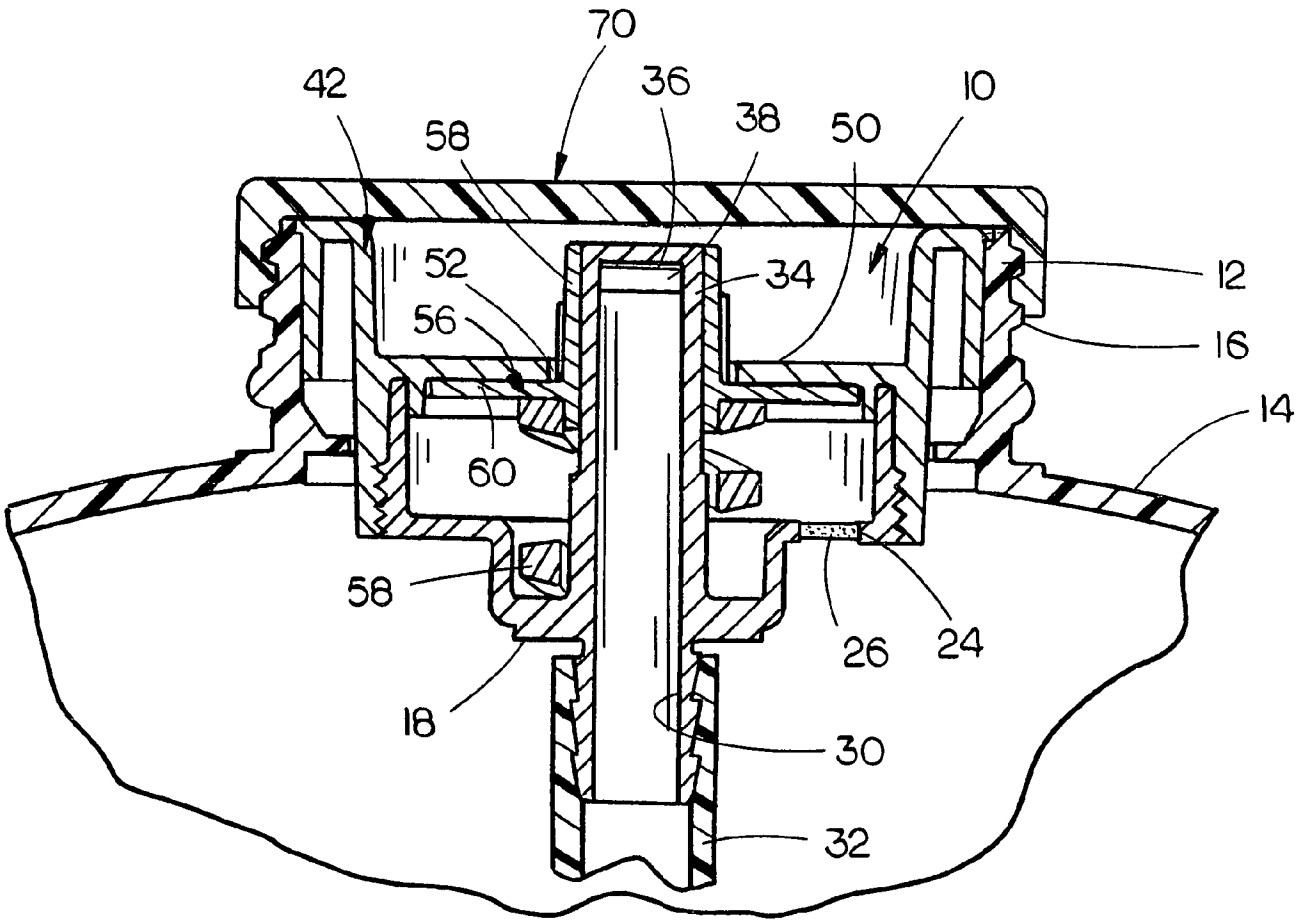
FIG. 6 is a sectional view similar to FIG. 5 except that the shipment cap is mounted on the container.

The numeral 34 refers to a hollow valve body which is integrally formed with disc member 18 and which is in communication with the interior of dip tube support 30. The upper end 36 of valve body 34 is closed, as seen in the drawings. The side wall of the side wall of valve body 34, below the upper end 36 thereof, has a pair of spaced-apart openings 38 formed therein to permit the liquid being drawn from the bottle 14, through dip tube 32, to pass through valve body 34, as will be described in detail hereinafter. Throat plug assembly 10 also includes a cup-shaped plug 40 which is inserted into the throat 12 of the bottle 14, as seen in FIG. 6. Plug 40 includes an outer wall 42 having a generally inverted U-shaped cross-section to define wall members 44 and 46. Wall 42 also includes an outwardly extending lip 48 on the upper end thereof for limiting the downward movement of plug 40 with respect to bottle 14. Plug 40 also includes a transversely extending wall 50 having a central opening 52 formed therein. Further, plug 40 includes an internally threaded portion 54 at its lower end which is adapted to threadably receive the external threads 28 of disc member 18 so that the upper end of valve body 34 extends through the central opening 52 of wall 50.

Figure 4:
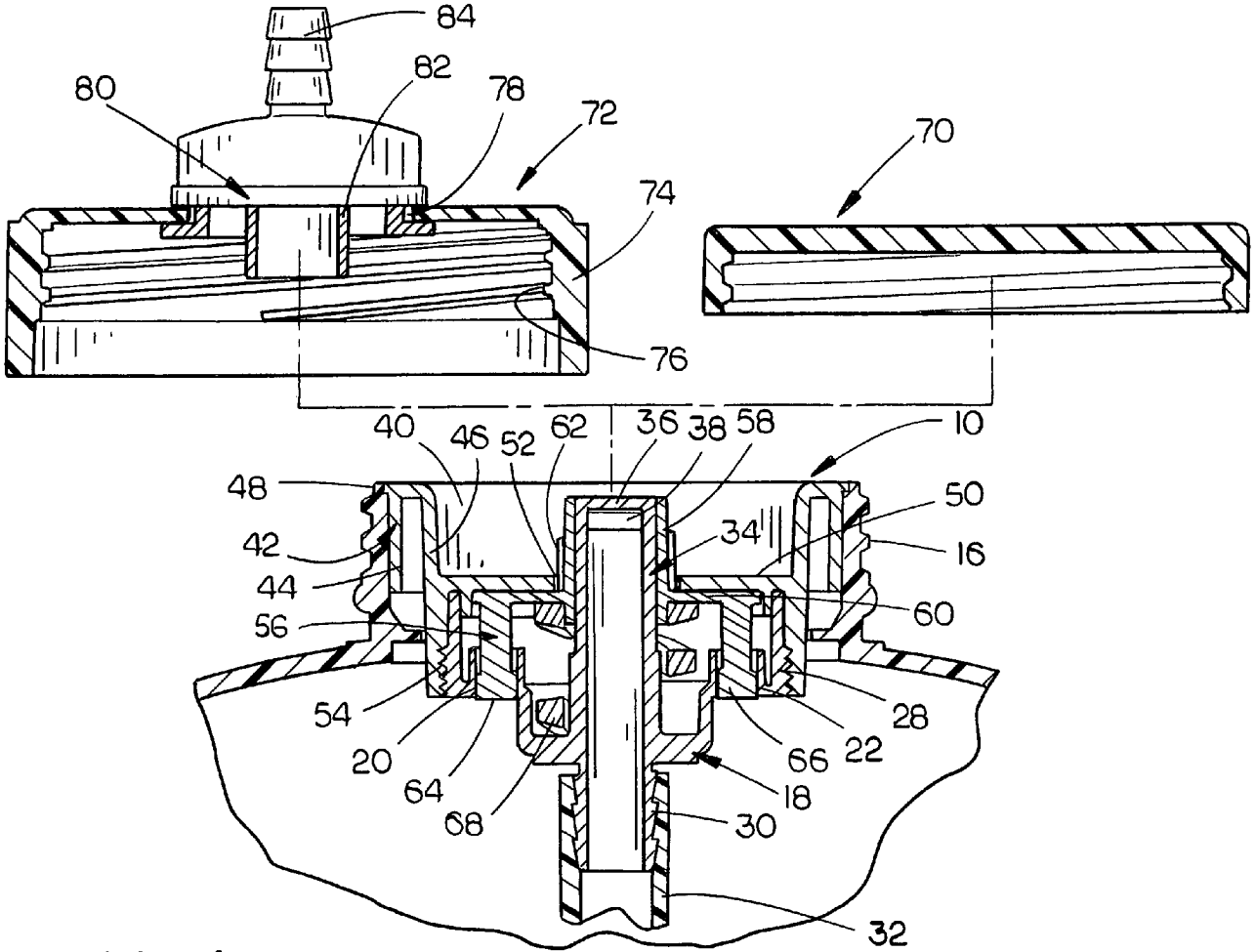
FIG. 4 is an exploded sectional view illustrating the throat plug assembly of this invention inserted into the throat of a liquid container and which also illustrates the operational cap and the shipment cap.
Figure 5:
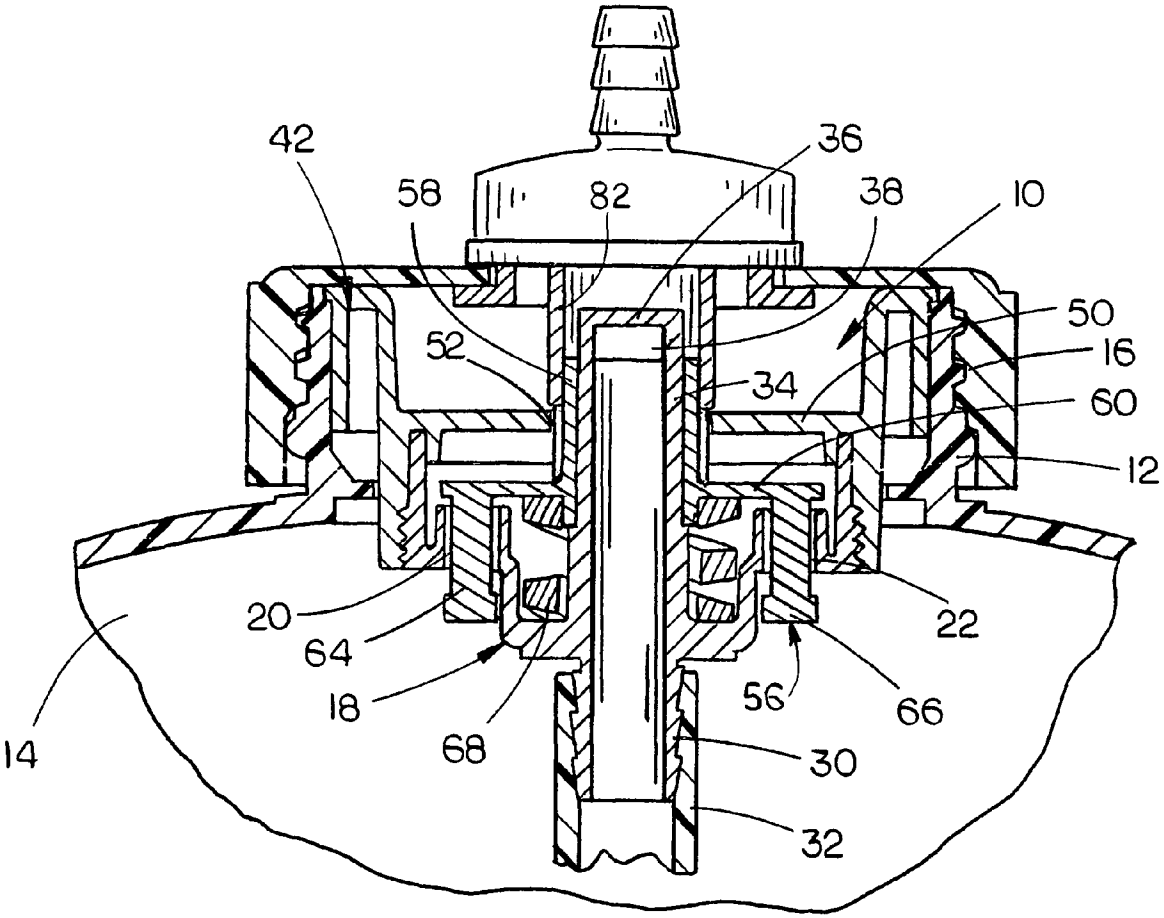
FIG. 5 is a sectional view illustrating the throat plug assembly of this invention mounted in the throat of the container with the operational cap mounted thereon which causes the mechanical venting to open the vent openings thereof.

The numeral 56 refers to a mechanical valve and vent assembly which is movably mounted on the valve body 34. Assembly 56 includes a vertically disposed hollow tubular portion 58, which vertically movably embraces the upper end of valve body, and a horizontally disposed disc 60 extending therefrom. The outer surface of tubular portion is provided with a plurality of radially spaced-apart tapered rubs 62 which are vertically disposed. As seen, disc 60 is disposed beneath wall 50 of plug with tubular portion 58 extending upwardly through opening 52 of wall 50. A pair of vent pins 64 and 66 extend downwardly from disc 60 and extend through the vent openings 20 and 22 of disc member 18 respectively. A plastic spring 68 embraces valve body 34 between the underside of disc 60 and the inner lower end of disc member 18 to normally yieldably urge the mechanical vent assembly 56 to its upper position of FIG. 4, so that pins 64 and 66 close the vent openings 20 and 22 respectively.

The numeral 70 refers to a shipping cap which is screwed onto the external threads 16 of throat 12 of the bottle 14. The numeral 72 refers to the operational cap portion of this invention. Cap 72 includes a locking collar 74 having internal threads 76 which are adapted to be threadably connected to the threads 16 on bottle 14. Collar 74 is provided with a central opening 78 formed therein which has receiver assembly 80 positioned therein which includes a cylindrical receiver 82 extending downwardly therefrom. The upper inner end of receiver 82 communicates with a dispensing tube support 84 which extends upwardly from cap 72 and has a dispensing tube mounted thereon which extends to a dispenser, mixer, etc. The lower inner end of receiver 82 is adapted to embrace the upper end of tubular support with the lower end of receiver 82 engaging the upper ends of the ribs 62.

In use, when the bottle 14 is being shipped from its place of manufacture to a distributor or user, the dipping cap 70 will be secured to the upper end thereof as seen in FIG. 6. Should the container or bottle 14 be experienced to undue heat or the like, the contents of the bottle 14 will tend to expand which could cause the bottle 14 to fail. The use of the Gortex® membrane 26 permits excessive pressure within the bottle 14 to escape upwardly therethrough and a certain amount of the pressure will be able to be vented from the bottle through the threads of the cap 70 and the threads 16 of the throat of the bottle.

When the bottle 14 is desired to be placed in operation, the cap 70 is removed therefrom and the cap 72 is threadably inserted onto the threads 16 of the throat 12. As the cap 72 is threadably tightened onto the bottle, the receiver 82, by its engagement with the hollow tubular portion 58 will cause the tubular portion 58 to move downwardly with respect to the valve body 34 thereby causing the openings 38 in the valve body 34 to communicate with the upper interior of the receiver 82 and the tube support 84. As the receiver 82 moves the tubular portion 58, the disk 60 and the pins 64 and 66 move downwardly so that the pins 64 and 66 cause the opening of the vents 20 and 22. Conversely, when the cap 72 is removed from the bottle, the pins 64 and 66 will again close the vent openings 20 and 22. The vertical movement of the pins 64 and 66 within the vent openings 20 and 22 tend to remove any debris which may have accumulated in the vent openings 20 and 22.

As liquid is being withdrawn from the bottle 14, air may enter the bottle 54 through the vent openings 20 and 22 to prevent collapsing of the bottle. Further, vent air is also able to pass through the vent opening 24 at that time.

Thus, it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. A liquid container having upper and lower ends;

said container having a hollow throat extending upwardly therefrom which has interior and exterior surfaces;

a throat plug assembly, having upper and lower end, positioned in said throat of said container;

said throat plug assembly including an upstanding, ring-shaped wall means at its upper end which engages the interior surface of said hollow throat of said container;

said throat plug assembly having a horizontally disposed upper wall which extends between said wall means;

said upper wall of said throat plug assembly having a central opening formed therein;

said throat plug assembly including a disc member at its lower end;

said disc member having a hollow dip tube support extending downwardly therefrom having the upper end of a dip tube secured thereto;

a dip tube in communication with said open lower end of said valve body and being in communication with the liquid in said liquid container;

said disc member including an upstanding hollow valve body having upper and lower ends;

said upper end of said hollow valve body being closed;

said lower end of said hollow valve body being open;

said hollow valve body having at least one opening formed therein below said upper end thereof;

said lower end of said hollow valve body being in fluid communication with said hollow dip tube support;

said lower wall portion of said disc member having at least one vent opening formed therein laterally outwardly of said hollow valve body;

a mechanical valve and vent assembly at the lower end of said throat plug assembly;

said mechanical valve and vent assembly including a horizontally disposed wall having a central opening formed therein;

said mechanical valve and vent assembly being vertically movably mounted on said hollow valve body;

said mechanical valve and vent assembly including a vertically disposed hollow tubular portion which vertically movably embraces the upper end of said hollow valve body;

said mechanical valve and vent assembly being movable between upper and lower positions with respect to said valve body;

said mechanical valve and vent assembly, when in its said upper position, closing the opening formed in said valve body below the upper end thereof;

said horizontally disposed wall of said mechanical valve and vent assembly having at last one vent pin extending downwardly therefrom which is received in the said one vent opening; said vent pin closing the associated vent opening when said valve and vent assembly is in its said upper position;

said vent pin permitting air to pass through the associated vent opening when said valve and vent assembly is in its said lower position;

a spring positioned between said disc member and said wall of said mechanical valve and vent assembly which normally urges said mechanical valve and vent assembly to its said upper position;

the vertical movement of said vent pin preventing the accumulation of debris in the associated vent opening;

said upper ends of said valve body and said tubular portion of said mechanical valve and vent assembly extending upwardly through said central opening in said throat plug assembly;

a cap removably mounted on said throat of said container for selectively closing said throat; and a dispensing tube extending from said cap for dispensing liquid from said container;

said cap including means for engagement with said tubular portion of said mechanical valve and vent assembly to move said mechanical valve and vent assembly to its said lower position to permit liquid to pass outwardly through said at least one opening in said hollow valve body;

the downward movement of said valve by said cap also causing said vent pin to open said vent opening.

2. The combination of claim 1 wherein an additional vent opening is formed in said lower wall portion of said disc member which has a membrane extending thereover which prevents liquid from passing therethrough but which permits air to pass therethrough.

3. The combination of claim 2 further including a shipment cap which replaces said cap and wherein the shipment cap does not cause said mechanical valve and vent assembly to move to its said lower position.

* * * * *